United States Patent [19]

Slocum et al.

[11] 4,422,266

[45] Dec. 27, 1983

[54] BUILDING PANEL

[75] Inventors: Donald H. Slocum, Villa Park; James W. Eaton, Sleepy Hollow, both of Ill.

[73] Assignee: Masonite Corporation, Chicago, Ill.

[21] Appl. No.: 374,281

[22] Filed: May 3, 1982

[51] Int. Cl.[3] ..... E04D 1/00

[52] U.S. Cl. ..... 52/58; 52/173 R; 52/527; 52/533; 206/323

[58] Field of Search ..... 52/58–60, 52/173 R, 518, 527, 460, 462, 533, 534, 560; 206/323, 324, 321

[56] References Cited

U.S. PATENT DOCUMENTS

| | | | |
|---|---|---|---|
| 1,431,869 | 10/1922 | Bergen | 52/323 |
| 1,978,519 | 10/1934 | Willock et al. | 52/533 |
| 2,110,485 | 3/1941 | Hunt | 52/541 |
| 2,264,546 | 12/1941 | Ochs | 52/541 |
| 3,375,622 | 4/1968 | Murray | 52/533 |
| 3,626,439 | 12/1971 | Kneisel | 52/533 |
| 3,848,383 | 11/1974 | Wilson | 52/533 |

*Primary Examiner*—Henry E. Raduazo
*Attorney, Agent, or Firm*—Mason,Kolehmainen, Rathburn & Wyss

[57] ABSTRACT

A building panel having inner and outer faces on a body outlined by opposite ends and by upper and lower edges with opposite ends of the panel adapted to closely face the end of an adjacent panel in the same course or row. The outer face of the panel includes a lower portion of substantially larger surface area adapted for weather exposure and an upper portion of relatively smaller surface area adapted to underlie a lower portion of the back face of one or more panels positioned in a next higher course. A flashing element is mounted on the outer face of the panel for precise pivotal movement between a first position wherein the element lies entirely within the outline of the panel body and a second position wherein the element extends outwardly beyond the body of the panel for flashing a joint between adjacent panels.

14 Claims, 12 Drawing Figures

BUILDING PANEL

BACKGROUND OF THE INVENTION

1. Field of the Invention

The present invention relates to man-made building panels formed of wood composite material suitable for use as exterior building wall and roof cover. The panels are provided with an outer weather surface shaped or embossed with a design resembling a plurality of shingles or shakes in combination with a flashing element which is pivotally mounted an outer face of the panel for movement between a first position lying entirely within the body of the panel (for shipment, handling and storage) and a second position extending outwardly of the panel body ready for flashing a joint between adjacent panels to be installed on a roof or wall surface.

2. Description of the Prior Art

A wide range and variety of relatively large building wall panels for sidewalls and roofs have been developed utilizing boards or substrates of composite wood materials embossed or shaped with an outer weather surface designed to resemble a plurality of shingles, shakes or conventional lap siding materials. U.S. Pat. No. 3,796,586 discloses a deep embossed, shingle lap siding formed of compressed wood fibers. U.S. Pat. No. 3,868,300 discloses a composite wall panel laminate having deep indentations formed with a tough, outer fibrous skin and a core of relatively course, less dense fibrous material. U.S. Pat. No. 4,279,106 is directed towards a roofing panel having a thin shell of hard plastic material with a cavity on the back face filled with polyurethane foam.

OBJECTS OF THE INVENTION

It is an object of the present invention to provide a new and improved, modular building panel for use a sloped roofs and/or vertical wall surfaces that is water proof, wind resistant, light in weight, weather resistant, aesthetically pleasing to the eye and easy of application.

Another object of the present invention is to provide a new and improved building panel of the character described which is formed of wood composite material and includes an outer weather surface shaped or embossed to resemble a plurality of individual shingles or shakes laid side by side in a common course on a roof or wall structure.

Still another object of the present invention is to provide a new and improved building panel of the character described in which a minimum amount of overlap or headlap is required between overlapping panels resulting in a reduced number of individual panels needed for covering a given area of wall or roofing surface.

Still another object of the present invention is to provide a new and improved building panel of the character described which is essentially self-aligning, easy and quick to install and which requires a minimal amount of installation labor during application on a roof or wall structure.

Still another object of the present invention is to provide a new and improved building panel of the character described having in combination therewith, a flashing element pivotally attached and movable into an outwardly extended position for flashing a joint between adjacent panels laid up in place on a roof or wall structure.

Yet another object of the present invention is to provide a new and improved self-flashing building panel which may be handled as a unit with a flashing element permanently attached thereto so as to preclude loss or separation of the flashing element from the body of the panel.

Still another object of the present invention is to provide a new and improved building panel flashing element combination wherein the flashing element is uniquely attached to the panel in a manner to automatically provide proper alignment of the flashing element during installation.

Still another object of the present invention is to provide a new and improved building panel and flashing element combination in which the flashing element is permanently attached to the body of the panel and is mounted in a position substantially protected against damage or loss during packaging, handling and shipping of the panel in bundles between a manufacturing site to the site of ultimate application or installation.

Still another object of the present invention is to provide a new and improved building panel and flashing element combination of the character described in which the visibility of joints between panels is minimized for providing an improved appearance of a roof or wall surface similar to shingles or cedar shakes.

BRIEF SUMMARY OF THE INVENTION

The foregoing and other objects and advantages of the present invention are accomplished in a new and improved building panel and flashing element combination wherein a body of the panel has inner and outer faces outlined by opposite ends and upper and lower edges. Opposite ends of the panel body are adapted to closely face the end of an adjacent panel in the same course or row and the outer face has a lower proportion of substantially larger surface area adapted for weather exposure and an upper portion of relatively smaller, narrow surface area adapted to underlie a lower portion of the back face of one or more of the panels positioned in a next higher course. The flashing element is permanently attached to the panel body on the outer surface for pivotal movement between a first position wherein the flashing element lies entirely within the outline of the panel body and a second position wherein the flashing element is pivoted to extend outwardly of the panel body for flashing a joint between adjacent panels. The flashing element is maintained in the first or protected position on the body during shipping and handling from the factory to the job site and when ready for application, the flashing element is pivoted into the second or extended position aligned to provide flashing for a joint between adjacent panels when laid up in place.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENTS

Figures 1, 2:
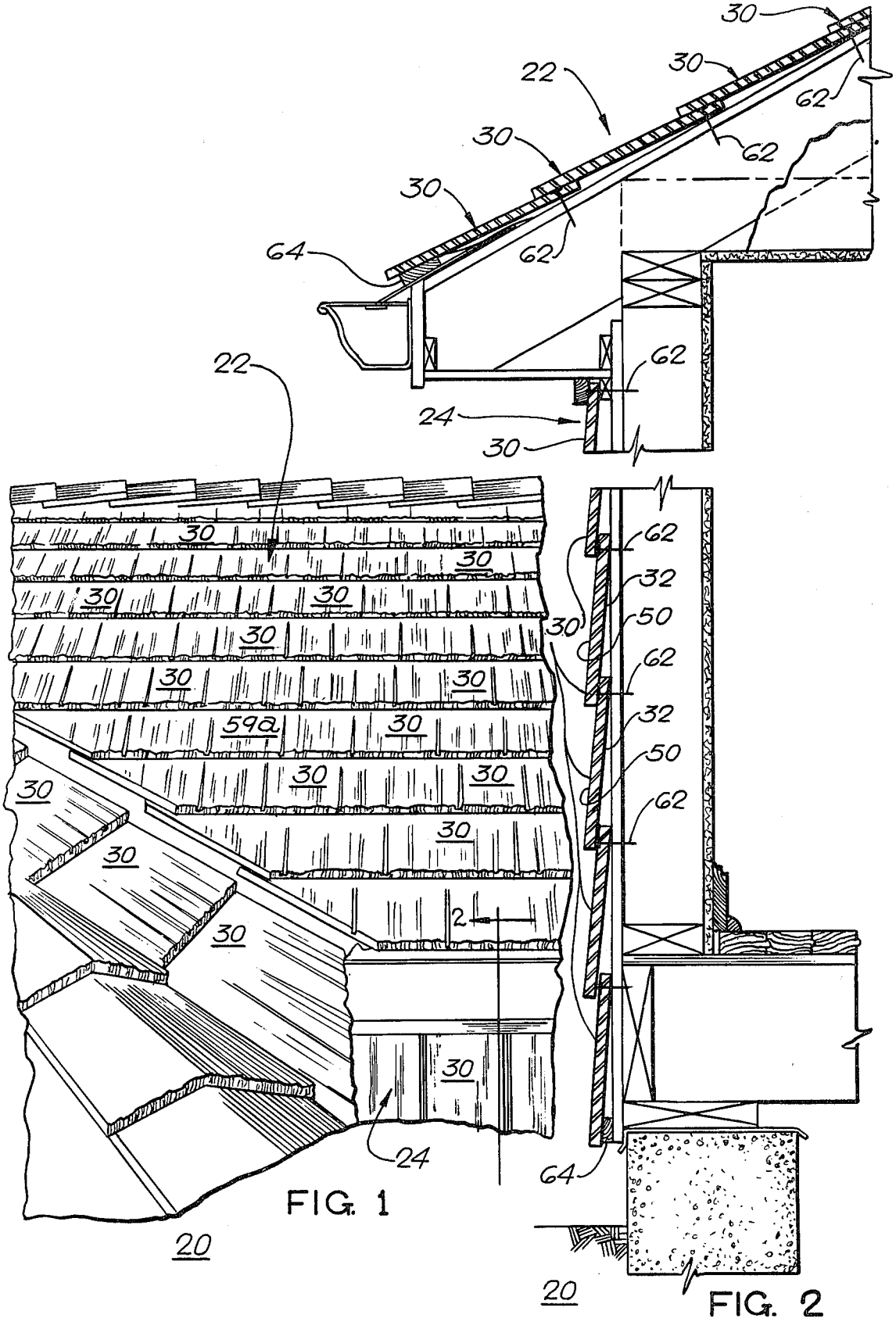
FIG. 1 is a fragmentary elevational view of a building structure utilizing a building panel and flashing element combination in accordance with the present invention illustrating the panels laid up in parallel courses or rows in overlapping relation.
FIG. 2 is a vertical cross-sectional view taken substantially along lines 2—2 of FIG. 1.
Figure 3:
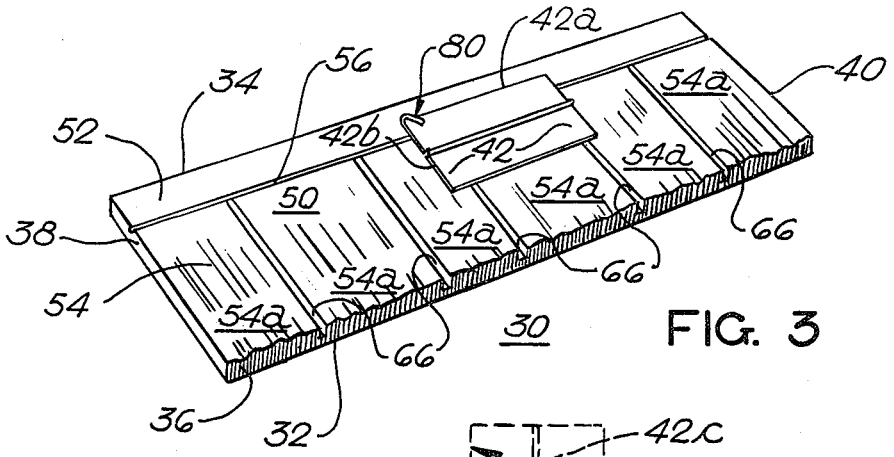
FIG. 3 is a perspective view of a new and improved building panel and flashing element combination in accordance with the features of the present invention showing the flashing element in a first operative position in relation to the body of the panel.

Referring now more particularly to the drawings, in FIGS. 1 and 2 is illustrated a building 20 of a general or conventional type employing a sloped roof structure 22 and vertical side walls 24. The roof and walls are covered with an outer or weather surface formed by a plurality of new and improved building panels 30 which are laid up in end-to-end relation in horizontal courses or rows. The panels in each succeeding higher course overlap an upper portion of the adjacent lower course or row as best shown in FIG. 2.

Each building panel 30 is preferably formed of suitable wood composite material such as flakeboard, chipboard, hardboard, plywood, etc. which is pressed into a body of a substantially uniform thickness and of a rectangular shape as shown in FIGS. 3, 4, 11 and 12. The panels include a relatively flat or planar back surface 32 bounded by an elongated upper edge or head 34 and a generally parallel, lower edge or butt edge 36 exposed to the weather. The panels include generally flat or planar, opposite, left and right hand end surfaces 38 and 40 perpendicular to the upper and lower edges. These ends are adapted to closely face the adjacent ends of panels laid end-to-end in the same or common course or row as best shown in FIG. 9.

Figure 9:
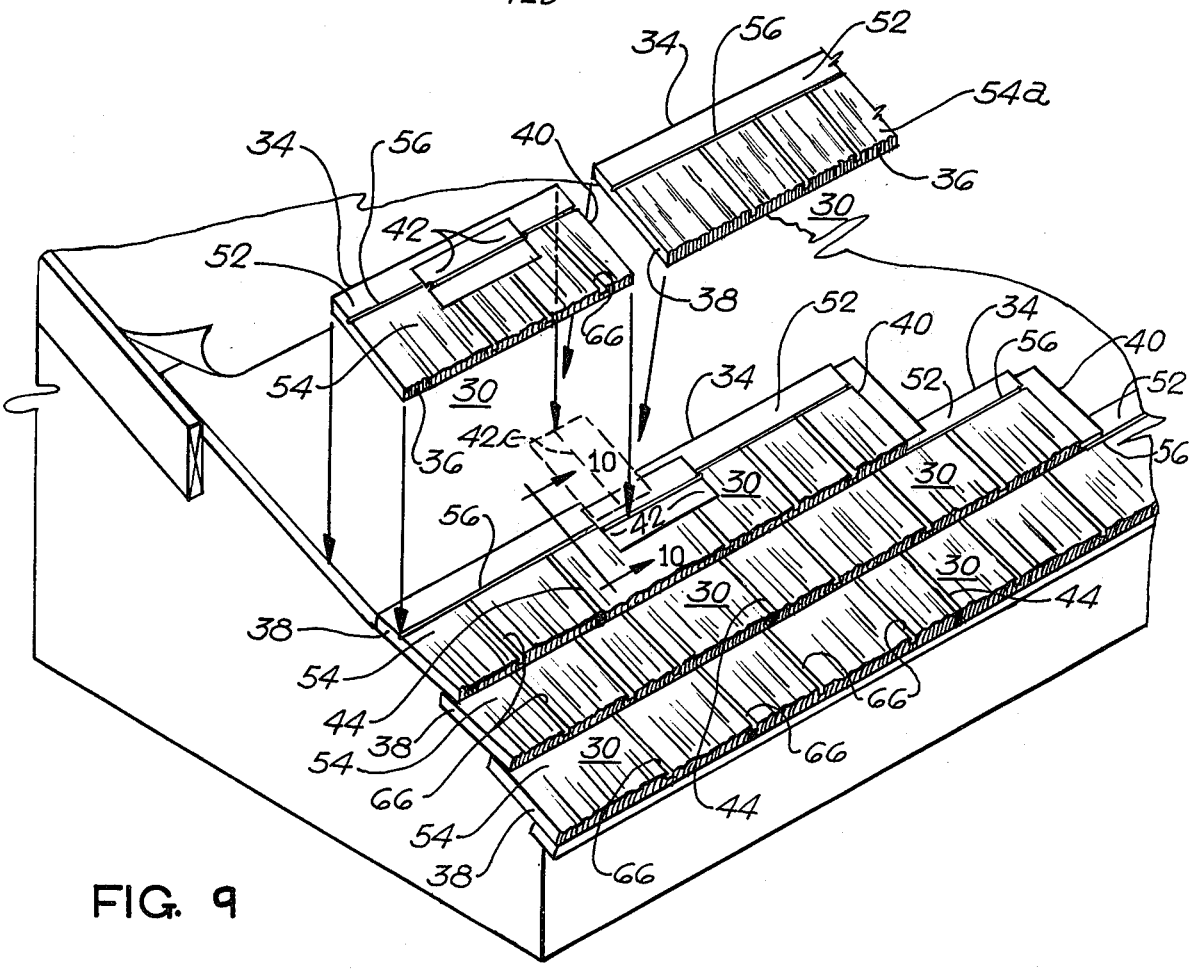
FIG. 9 is fragmentary, perspective view of a typical roof structure of a building illustrating in animated form the installation process of laying up the panels and pivoting the flashing elements into extended position.

As best shown in FIG. 9, joints formed between adjacent end surfaces 38 and 40 of panels in a common course or row, are flashed with a sheet metal flashing element 42 which is permanently mounted on an outer weather face 50 of a panel 30 in the next lower row or course. In the first or starter course or row of a roof or wall surface, conventional individual flashing sheets are used. Normally, such flashing sheets include an upstanding head flange at the upper end to fit against the upper edge or head 34 of the building panels in the first or starter course to aid in securing the flashing in place on a roof or wall while the panels are secured to the wall. A small gap or space 44 is normally provided between adjacent facing ends 38 and 40 of each pair of panels in a row in order to accommodate any lateral expansion of the panels. The metal flashing elements tend to channel any water in these joint gaps or spaces down onto the outer surface of the panels in the next lower row or course.

In accordance with the present invention, the building panels 30 are formed with an outer or weather face 50 which is generally parallel to the back face 32 except for the minor variations in the thickness because of the shaping or embossing process and at the grooves as will be described hereinafter. The outer surface of each panel 30 is divided to provide a relatively flat and smooth narrow strip or head lap segment 52 along the upper edge and the area of this strip comprises only a fractional or minor portion of the total or overall surface area of the whole building panel. This narrow head lap segment along the upper edge 34 is adapted to underlie a narrow strip of back face 32 along a lower portion of each succeeding panel or panels as they are laid up in place in a next adjacent upper row or course (as shown in FIG. 2). When laid up in place as shown, the narrow overlapping or confronting portions of the panels form a substantially water tight head lap between successive courses or rows of panels on a wall or roof.

The outer weather face of each panel includes an embossed lower surface portion 54 lying below the narrow upper margin 52 and delineated therefrom by a thin, fastener marker line or shallow groove 56 parallel of and spaced between the upper edge 34 and the lower, exposed butt edge 36. The shallow groove or line 56 provides guidance for aid in aligning subsequent rows or courses of panels on a building wall or roof surface.

Figure 5:
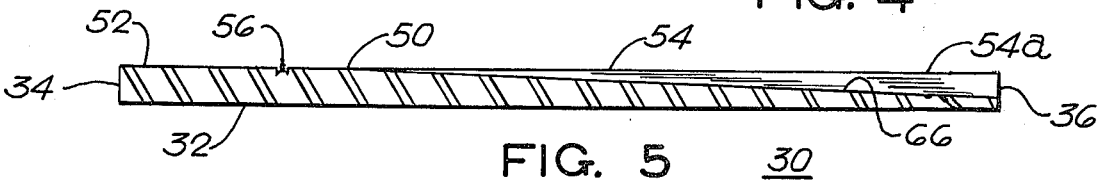
FIG. 5 is a cross-sectional view taken substantially along lines 5—5 of FIG. 4.
Figure 6:
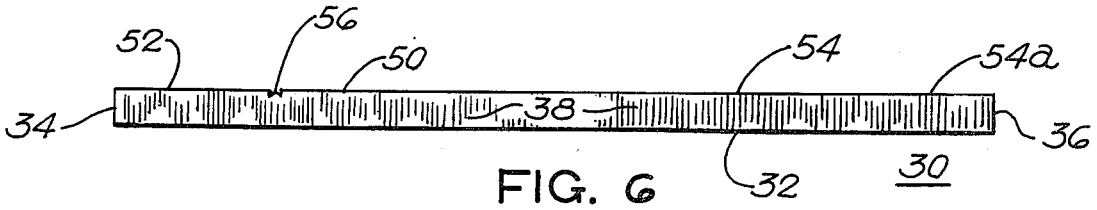
FIG. 6 is an end elevational view of the panel of FIG. 4 looking in the direction of arrows 6—6.
Figure 7:
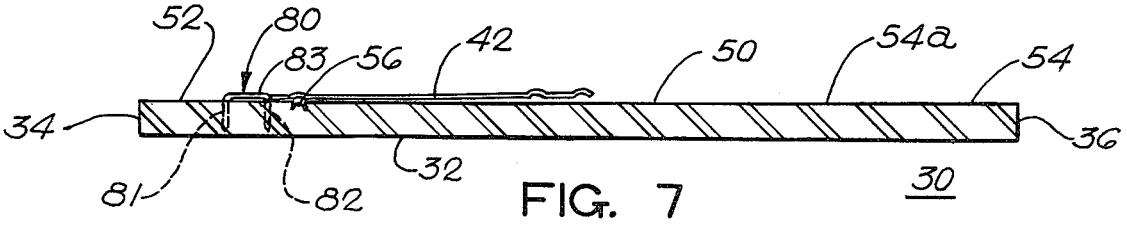
FIG. 7 is a cross sectional view taken substantially along lines 7—7 of FIG. 4.

The weather or exposed outer face 54 of the outer surface 50 is shaped or deep embossed to resemble closely in appearance, a plurality of individual shingles or shakes 54*a* of random width and order, laid up in side by side relation in a row or course as illustrated. Each shingle element 54*a* terminates along a lower butt edge coincident with the longitudinal edge 36 of the whole building panel 30. Between each pair of adjacent individual shingle elements 54*a* embossed in the surface 54, there is provided a tapered groove or channel 66 which is shown in enlarged detail in FIG. 5. These grooves or channels are dimensioned to taper from a shallow or minimum depth at the upper end adjacent the nailing guide groove or line 56 to a greater or maximum groove depth adjacent the lower or butt edge 36 of the building panel. Each groove breaks out or becomes substantially even with the outer surface of the adjacent pair of embossed shingle elements 54*a* on each side just before reaching the level of the nailing guide line 56. Preferably, the grooves reach a maximum depth at or adjacent the lower butt edge of the panel and this maximum depth may be equal to or less than the nominal thickness of the panel edge.

The tapered grooves with the deep relief provided at the lower or butt edge 36 of the panels results in an overall appearance remarkably indistinguishable from that of a plurality of shingles or shakes laid up or installed on a or roof or wall surface. Along the relatively thick, butt edge 36 of each panel, the grooves 66 between each pair of adjacent embossed shingle elements 54*a* are deep and provide the appearance of a space between separate shingles or shakes.

The tapered, deepening grooves form a thick shadow appearance which truly and accurately visually resembles a building surfaced with shingles or cedar shakes. Because the grooves 66 taper to a minimum depth and break out at the upper end thereof adjacent the nail guide line 56 before reaching the head lap strip area 52, there is little chance that wind driven water will be forced under the head lap between adjacent courses of panels. Instead, any water will tend to spill out from the sides of the grooves at the shallow upper end and then run back down the outer faces 54*a* of the adjacent shingle elements on either side of the groove.

The unique grooves 66 also provide another enhancing feature in that the building panel 30 is dimensioned to retain full nominal thickness uninterrupted for the entire length thereof above the nailing guide grooves 56 and in this area 52, fastening attachment to a building wall or roof is accomplished at the strongest portion of each panel. The panels 30 are thus strong where needed and are not subject to peel-up or fish mouthing which is a problem with many shingles and roofing materials. The tapered grooves 66 provide a panel 30 which closely resembles a plurality of shingles or cedar shakes, yet without requiring the great amount of labor that is normally required in the application of such. Moreover, the uniquely shaped grooves greatly enhance the appearance of the panels 30 and do not detract from the strength thereof where needed because at the fastening area on the head lap strip 52, the panel body is maintained at full nominal thickness. The tapered grooves provide deep shadows and relief to form an appearance closely simulating a plurality of shingles or shakes without the high cost of application thereof.

Figure 10:
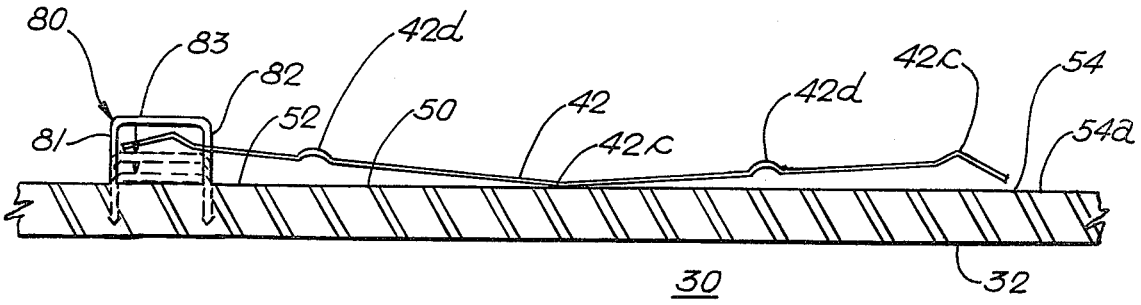
FIG. 10 is an enlarged fragmentary, cross-sectional view taken substantially along lines 10—10 of FIG. 9.

In accordance with the present invention, each building panel 30 is provided with a sheet metal flashing element 42 permanently attached thereto on the outer face as best shown in FIGS. 3, 4 and 7–11. The sheet metal flashing elements are generally rectangular in shape and are secured in place on the outer face of a building panel by means of a U-shaped fastener element or staple 80 having a pair of legs 81 and 82 (FIG. 8) which extend downwardly into the body of the panels 30 as indicated in FIG. 10.

Figure 4:
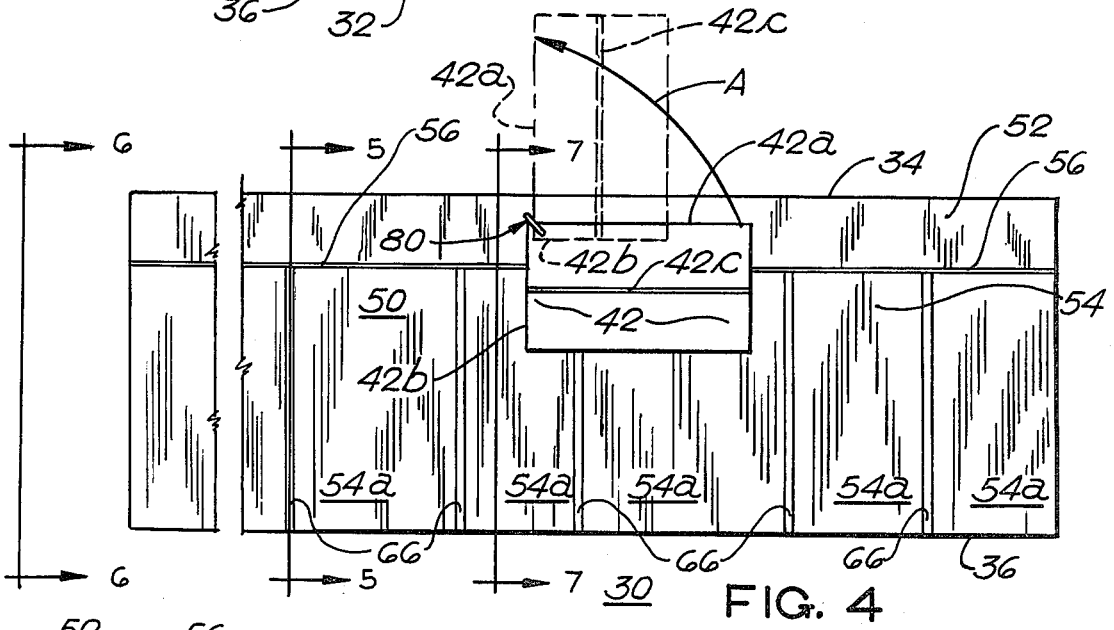
FIG. 4 is a plan view of the outer or weather surface of the building panel and flashing element combination of FIG. 3 showing in animated fashion the pivotal movement of the flashing element from a first position to a second or extended operative position ready for flashing a joint be adjacent panels installed on a building wall or roof structure.
Figure 8:
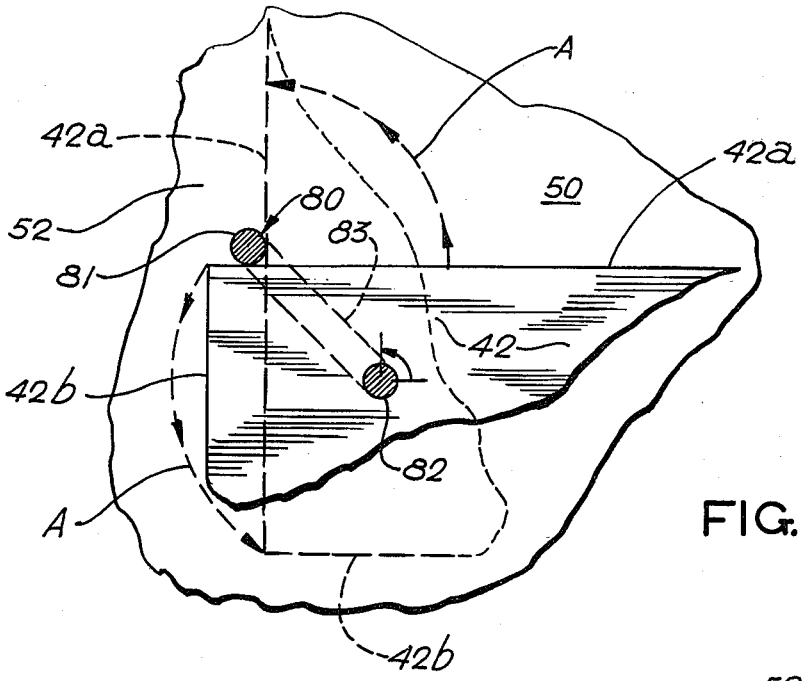
FIG. 8 is a greatly enlarged fragmentary plan view of a corner portion of a flashing element and novel fastening means utilized for securing the flashing element in place on the outer face of the panel.
Figure 12:
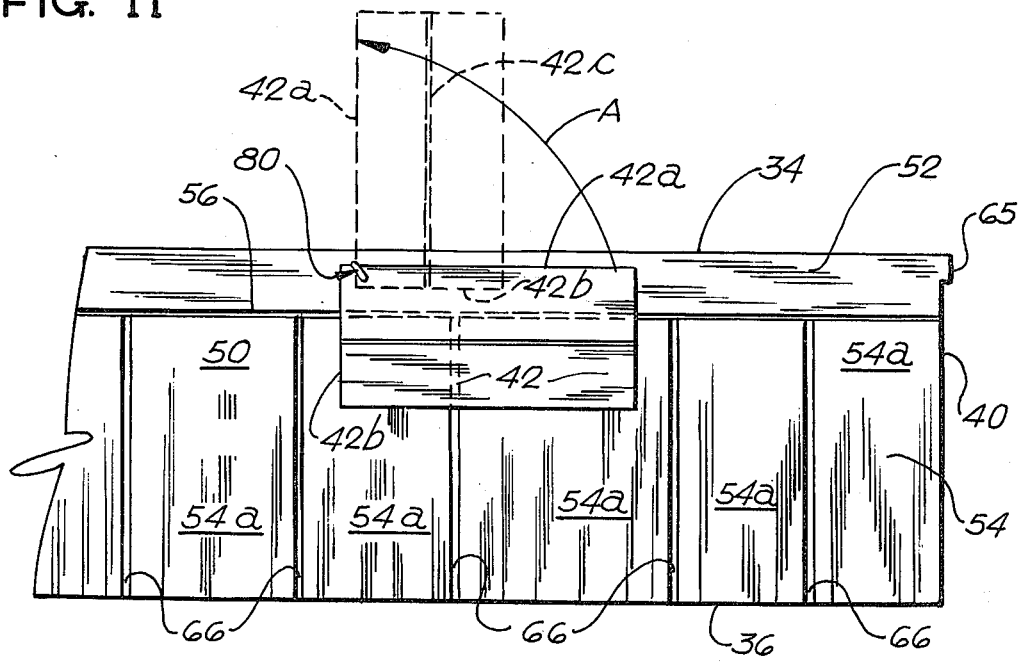
FIG. 12 is a fragmentary view of the outer face of the building panel and flashing element combination of FIG. 11 illustrating in animated fashion the pivotal movement or path of the flashing element as it pivoted from one position to another extended position ready for flashing a joint between panels adjacent thereto.

The upper ends of the staple legs are interconnected with the bight portion 83 which overlies an upper surface of the flashing element and is arranged at approximately a 45° angle (FIG. 8) to a longitudinal axis of the panel body. In the position shown in solid lines in FIGS. 4 and 12, a side edge 42*a* is parallel of the longitudinal edge of the panel and a lower edge 42*b* of the flashing element is normal thereto. As best illustrated in FIGS. 4, 8 and 12, the staple leg 82 provides a pivot axle for a lower corner portion of the sheet metal flashing element 42 supporting the element for pivotal movement from a first position (solid lines) wherein the flashing element lies in a protected position entirely within the border or outline of the larger panel body and extends generally longitudinally of the length of the panel body. In this protected position (assembled at the factory), the outer edges and corners of the flashing element are protected from damage or bending by the portions of the panel body projecting outwardly thereof and the panels with attached flashing elements thereon can be conveniently stacked in bundles and the like without much danger of damage to or loss of the flashing element associated therewith. Separation of the elements from their associated panel body is eliminated and a roofer does not have to handle separate bundles or packages of flashing elements in addition to the roofing or siding panels.

In the first position as shown in solid lines, a lefthand edge 42*a* of each flashing element bears against the staple leg 81 which serves as a stop for preventing further clockwise pivotal movement of the flashing element on the panel body. When it is desired to secure the panel 30 in place on a wall structure, the flashing element 42 is manually pivoted or rotated about the staple leg 82 in a counterclockwise direction (as indicated by the arrows "A") by approximately 90° into an outwardly extending, second position wherein a longitudinal central axis or crease 42*c* at the center of the flashing element is extending upwardly beyond the upper edge 34 of the panel body at a 90° angle. In this extended position, the flashing element 42 is ready to provide a flashing function for a joint formed between adjacent ends of a pair of panels laid up in the next higher course on a building wall or roof structure.

When the flashing element is pivoted into the second or outwardly extending, flashing position ready for flashing a joint between the ends of a pair of panels in the next higher course, the lefthand edge 42*a* of the element 42 is stoppingly engaged against the staple leg 81 which serves as a stop pin to properly position the flashing element with the center axis 42*c* at precisely 90° to the upper edge 34 of the panel body. The building panel/flashing element combination thus provides an automatically self-flashing panel system which is easy to install and eliminates the possibility of individual flashing elements being left out or becoming separated or lost. The permanently attached flashing provides for much easier and faster application and flashing of the panels as they are applied or installed on a wall or roof. The flashing elements are merely pivoted into the upwardly extending position as shown in dotted lines in FIGS. 4, 8 and 12, with the center line or crease 42*c* of the flashing elements available as a course offset guide line for automatically staggering the joints or spaces 44 between adjacent end surfaces 38 and 40 of each pair panels 30 in the next higher row or course.

Preferably, the flashing elements 42 are assembled onto the outer face 50 of the building panels 30 at the factory and are normally maintained in the first or protected storage position by downward pressure exerted onto the flashing element by the bight portion 83 of the staple or fastener 80 as it is driven home (FIG. 10). This pressure is not so great as to preclude manual pivotal movement of the flashing element into the second or outwardly extending position when ready for application, and pivoting the element is easily accomplished by grasping a lower righthand corner of the flashing element (as shown in FIGS. 4 and 12) and rotating the element in a counterclockwise direction as indicated by the arcuate arrows "A" into the upstanding or extended, second position (dotted lines).

As illustrated in FIG. 10, the sheet metal flashing element may be stiffened against bending or peel-back with pairs of longitudinally extending deformations or ribs 42*d* and 42*e* formed therein and spaced on opposite sides of the centerline crease 42*c*. The flashing elements also may be flat or planar sheet metal without any stiffening ribs and a minimal angle of crease 42*c* across the longitudinal center thereof.

The attaching fastener or staple 80 is positioned to lie in the narrow strip or headlap portion 52 on the outer face of the building panel 30 and the pivot leg 82 extends through an opening or aperture in a lower corner portion of the flashing element 42. The staple and opening are positioned so that a lower edge 42*b* of the flashing element does not extend downwardly below the nailing guide line marker groove 56 when the flashing element is pivoted into the upwardly extending, flashing position as shown in dotted lines.

The position of the fastening staple 80 longitudinally on the building panel between opposite end faces 38 and 40 may be selected to be a fraction of the total length of the panel, for example, ⅓ of the length of the panel inwardly from a righthand end. If, for example, the position of the centerline 42*c* of an outwardly extended flashing element 42 is located ⅓ of the way in from one end of the panel, the joints 44 between ends of the building panels will repeat alignment every third course. It has been noted, however, that because of the patterns, width and orientation of the individual shingle-like surfaces 54*a* of a panel, a repeating pattern is difficult to visually perceive when the panels are in place on a roof or wall structure.

Figure 11:
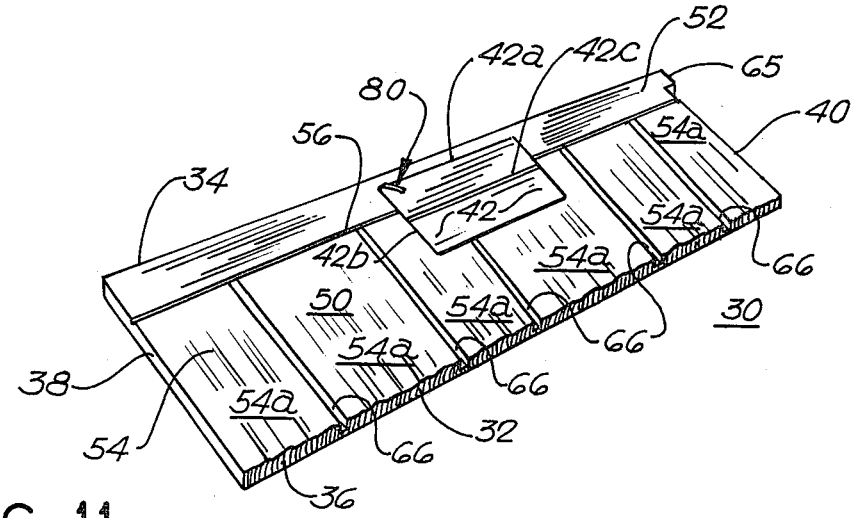
FIG. 11 is a perspective view of another embodiment of building panel and flashing element combination in accordance with the features of the present invention.

Referring now to FIGS. 11 and 12, the panel body 30 therein illustrated is provided with a spacer or projection 65 on a righthand end face 40 extending laterally outwardly thereof so that when a next adjacent panel is abutted against an outer surface of the projection, a joint space 44 having a width similar to that of the grooves 66 in the panel body is automatically established. The spacer or projection is formed at the upper end of the panel body in the region of the narrow headlap strip 52 and the projection or spacer does not extend downwardly below the nailing guide groove or line 56. Accordingly, the spacer or projection 65 is shielded from the weather by the next overlapping row or course of panels and is not subjected to expansion forces as may be the substantial area 54 of the lower portion of the panels exposed to the weather. The precise width of joints 44 established by the spacers permits the ends of the adjacent exposed lower portion of the panel body to laterally expand without danger of buckle, turn up or warping of panels or between pairs of adjacent facing panel ends 38 and 40 in a common row or course of panels.

As illustrated in FIG. 9, when a roof or building wall structure is surfaced with the building panels 30, a first or starter course is installed along a lower edge or eave normally with a left hand end 38 of a first panel in the course extended outwardly beyond a "saw line" which in turn is spaced outwardly of a rake edge or corner of the building. Successive panels in the first course are then laid end to end along the row with a conventional flashing. At the joints between panel ends. The flashing elements 42 on the panels 30 of this starter course are pivoted upwardly as shown in dotted lines ready for flashing the joints between panel ends of adjacent panels in the second course. A second course is started with the left hand end 38 of a first panel in the course extended outwardly to the left even beyond the left hand end of the end panel in the first course.

Similarly, the left end panel in the third course extends outwardly to the left farther than the starter panel of the second course. Eventually these outwardly projecting panel end portions are cut off along the "saw line". The cut off portions may sometimes be utilized at the opposite (right hand) end of the course or on other parts of the structure depending upon the lengths thereof and distance coverage required. The application process as described may also be initiated from a right hand corner along the lower edge or eave and the panels may be aligned end to end in each course or row from right to left proceeding to the lefthand rake edge of the building or roof structure.

In applying the panels 30 to a roof or wall surface it is recommended that the panels be installed over a minimum base of ½ inch thick CDX plywood or equivalent sheathing or decking. The sheathing or decking should also be covered with a layer of 15 pound asphalt felt or similar material prior to installation of the panels thereon. Nails or staples 62 are used to secure the panels in place and these fasteners are driven above the nailing line or groove 56 in the narrow, head lap or strip area 52, so as not to be exposed to the weather. Generally, galvanized roofing nails or staples are recommended, and normally five or six spaced apart fasteners are used to hold a 48" long building panel in place.

In practice, panels having a nominal length of 48 inches are preferred and panels of this size can be handled and applied by one man. Along the lower edge of a building wall or the eave of roof structure, a narrow starter strip 64 is utilized for the first course and preferably a lower edge of the starter strip is spaced a slight distance upwardly above the lower or thick butt edge 36 of the panels 30 of the starter course as illustrated in FIG. 2.

In a typical commercial embodiment of the present invention, panels 30 are dimensioned to be approximately 47 and 3/16th inches in length and 11 and 13/16th inches in width with a 3 inch wide head lap being provided between the upper edge 34 and the nail guide grooved line 56. The panels are nominally 7/16th inches thick and are packaged with 6 panels per bundle. In this size, only 6 bundles are required to cover 100 square feet or one "square" of a building roof or wall structure. Panels 30 having these size parameters produce a weight of approximately 240 pounds per "square" of surface area covered. This weight is comparable to that of many asphalt shingles but the panels 30 provide a great advantage in terms of the small number of pieces (36) necessary for covering a "square" of surface area. The panels 30 are recommended for use on roof slopes of 4 in 12 or steeper and are economical for use in new construction as well as for re-siding or re-roofing application over old materials already in place.

The flashing elements 42 may be made of 22, 24, 26 gauge thickness, aluminum, galvanized sheet metal etc. and attached with staples 80, preferably of corrosion resistant material such as galvanized steel. The flashing elements are sized to be approximately 6" in width and approximately 12" long, measured in the upwardly extending position.

Although the present invention has been described with reference to several illustrated embodiments thereof, it should be understood that numerous other modifications and embodiments can be made by those skilled in the art that will fall within the spirit and scope of the principles of this invention.

What is claimed as new and is desired to be secured by Letters Patent is:

1. A building panel having inner and outer faces outlined by opposite ends and by upper and lower edges, said opposite ends of said panel adapted to closely face the end of an adjacent panel in the same course, said outer face having a lower portion of substantially larger surface area adapted for exposure and an upper portion of relatively smaller surface area adapted to underlie a lower portion of one or more of said panels positioned in a next higher course; and a flashing element mounted on said panel for pivotal movement between a first position wherein said element lies entirely within the outline of the panel bounded by said opposite ends and said edges and a second position wherein said element extends outwardly across said outline for flashing a joint between adjacent panels.

2. The building panel of claim 1 wherein said flashing element is extended upwardly beyond said upper edge of said panel intermediate said opposite ends thereof when pivoted to said second position for flashing a joint between adjacent ends of panels laid end to end in a next higher course.

3. The building panel in claim 1 including fastener means for securing said flashing element on said outer face of said panel for pivotal movement between said first and second position.

4. The building panel of claim 3 wherein said fastener means is positioned on said upper portion of relatively smaller surface area of said panel and is positioned adjacent a lower edge corner of said flashing element when said element is in said second position.

5. The building panel of claim 4 wherein said fastener means is positioned relatively to said lower edge corner of said flashing element so that said element does not extend downwardly beyond said upper, smaller surface area portion of said panel when pivoted into said second position.

6. The building panel of claim 4 wherein said lower edge of said flashing element is at a level adjacent or above a lower edge of said upper smaller surface area portion of said panel when said flashing element is in said second position.

7. The building panel of claim 4 wherein said lower corner of said flashing element is formed by a lower edge and a side edge extending upwardly of said building panel when said element is pivoted to said second position.

8. The building panel of claim 7 wherein said fastener means includes a stop leg positioned to engage said side edge of said flashing element in said first position and to engage said side edge at a different point thereon when said element is pivoted into said second position.

9. The building panel of claim 8 wherein engagement of said side edge of said flashing element with said stop leg limits the pivotal movement of said flashing element on said building panel movement between said first and second position.

10. The building panel of claim 9 wherein said fastener means includes a second leg spaced from said stop leg forming a pivot axle for said flashing element for movement between said first and second positions.

11. The building panel of claim 10 wherein said fastener means comprises a U-shaped element with said second leg projecting through said flashing element into said building panel and said stop leg projecting into said building panel outside of said flashing element.

12. The building panel of claim 11 wherein said fastener means includes a bight interconnecting said legs and overlying said lower corner edge of said flashing element.

13. The building panel of claim 1 wherein said flashing element is formed of thin sheet material and includes means extending longitudinally along a center thereof adapted to mark a joint line between panels end to end in a next higher course.

14. The building panel of claim 13 wherein said flashing element is formed of sheet metal and said mark comprises a crease formed in said metal.

* * * * *